US006040812A

United States Patent [19]

Lewis

[11] Patent Number: 6,040,812

[45] Date of Patent: Mar. 21, 2000

[54] ACTIVE MATRIX DISPLAY WITH INTEGRATED DRIVE CIRCUITRY

[75] Inventor: Alan G. Lewis, Sunnyvale, Calif.

[73] Assignee: Xerox Corporation, Stamford, Conn.

[21] Appl. No.: 08/666,033

[22] Filed: Jun. 19, 1996

[51] Int. Cl.[7] ..... G09G 3/36

[52] U.S. Cl. ..... 345/89; 345/147

[58] Field of Search ..... 345/89, 92, 100, 345/147

[56] References Cited

U.S. PATENT DOCUMENTS

| | | | |
|---|---|---|---|
| 5,185,602 | 2/1993 | Bassetti, Jr. et al. | 340/793 |
| 5,459,495 | 10/1995 | Scheffer et al. | 345/147 |
| 5,479,188 | 12/1995 | Moriyama | 345/149 |
| 5,488,495 | 1/1996 | Numao | 359/56 |
| 5,491,347 | 2/1996 | Allen et al. | 257/59 |
| 5,508,716 | 4/1996 | Prince et al. | 345/103 |
| 5,510,807 | 4/1996 | Lee et al. | 345/103 |
| 5,521,727 | 5/1996 | Inaba et al. | 359/56 |
| 5,557,534 | 9/1996 | Wu | 364/491 |

FOREIGN PATENT DOCUMENTS

| | | | |
|---|---|---|---|
| 0528685 | 2/1993 | European Pat. Off. . | |
| 540163A2 | 5/1993 | European Pat. Off. | H03K 17/955 |
| 546780A1 | 6/1993 | European Pat. Off. | G09G 3/36 |
| 0646906 | 4/1995 | European Pat. Off. . | |
| 0709823 | 5/1996 | European Pat. Off. . | |

OTHER PUBLICATIONS

Lee, D.D., DaCosta, V.M., and Lewis, A.G., "A VLSI Controller for Active–Matrix LCDs," 1994 *IEEE International Solid–State Circuits Conference*, 1994, pp. 156–157.

Lewis, A., Bruce, R., "Circuit Design and Performance for Large Area Electronics," 1990 *International Solid–State Circuits Conference*, 1990, pp. 222–223.

Lewis, A., Da Costa, V., and Martin, R., "Poly–Si TFT Driver Circuits for a–Si TFT AMLCDs," *SID 94 Digest 1994*, pp. 251–254.

Kaneko, E., "Novel Key Technologies Used to Fabricate Very–Large–Area TFT–LCD Panels," *SID 95 Digest*, May 1995, pp. 150–153.

Hornbeck, L.J., "Current Status of the Digital Micromirror Device (DMD) for Projection Television Applications," *1993 IEDM Technical Digest*, 1993, pp. 381–394.

Stewart, R.G., Lee, S.N., Ipri, A.C., Jose, D.L., Furst, D.A., Lipp, S.A., and Roach, W.R., "A 9V Polysilicon LCD with Integrated Gray–Scale Drivers," *SID 90 Digest*, pp. 319–322.

Lee, S.N., Stewart, R.G., IPri, A., Jose, D., and Lipp, S., "A 5×9 inch Polysilicon Gray–Scale Color Head Down Display Chip," *1990 IEEE International Solid–State Circuits Conference*, IEEE, 1990, pp. 220 and 221.

(List continued on next page.)

*Primary Examiner*—Amare Mengistu

[57] ABSTRACT

An image output device such as display or a light valve, has cells, each with an electrooptical element and a switching element. During a duty interval of a scan signal on a scan line, the switching element electrically connects the electrooptical element to receive a data signal from a data line. Scan drive circuitry can provide the scan signal with a scanning frequency that is at least K times the lesser of the maximum response frequency of the electrooptical element and a normal human viewer's maximum perceptual frequency, where K is eight or more. Data drive circuitry can receive digital input signals and respond by providing, during each duty interval of the scan signal, a signal segment with either a maximum or a minimum voltage magnitude. The electrooptical element can receive, during each duty interval, either approximately the maximum voltage magnitude or approximately the minimum voltage magnitude and can present, through time averaging, any of K distinct, continuous gray levels without perceptible flicker.

20 Claims, 7 Drawing Sheets

OTHER PUBLICATIONS

Fisk, T., Hack, M., Martin, R.A., and Steemers, H., "Analysis of Transient Optical Response of Active–Matrix LCDs," *SID 95 Digest*, May 1995, pp. 743–746.

Lewis, A.G., Lee, D.D., and Bruce, R.H., "Polysilicon TFT Circuit Design and Performance," *IEEE Journal of Solid–State Circuits*, vol. 27, No. 12, Dec. 1992, pp. 1833–1842.

Lewis, A.G., and Turner, W., "Driver Circuits for AMLCDs, "*Conference Record of the 1994 International Display Research Conference and International Workshop on Active on Matrix LCDs & Display Materials*, Monterey, California, Oct. 10–13, 1994, pp. 56–64.

Morozumi, S., Oguchi, K., Misawa, T., Araki, R., and Ohshima, H., "4–25–in. and 1.51–in. B/W and Full–Color LC Video Displays Addressed by Poly–Si TFTs," *SID 84 Digest*, 1984, pp. 316–319.

Wu, I–W., "High–definition displays and technology trends in TFT–LCDs," *Journal of the SID*, vol. 2, No. 1, 1994, pp. 1–14.

Kaneko, E., *Liquid Crystal TV Displays: Principles and Applications of Liquid Crystal Displays*, Tokyo: KTK Scientific Publishers, 1987, pp. 211–277.

Takfuji, Y., Yamashita, T., Shimada, T., Akebl, Y., Matsumoto, T., Tsubota, K., Fujoka, K., and Awane, K., "A 1.9–In. 1.5–MPixel Driver Fully–Integrated Poly–Si TFT–LCD for HDTV Projection," *SID 93 Digest*, 1993, pp. 383–386.

Wu, I–W., Stuber, S., Tsai, C.C., Yao, W., Lewis, A., Fulks, R., Chiang, A., and Thompson, M., "Processing and Device Performance of Low–Temperature CMOS Poly–TFTs on 18.4–in. Diagonal Substrates for AMLCD Application," *SID 92 Digest*, 1992, pp. 615–618.

ACTIVE MATRIX DISPLAY WITH INTEGRATED DRIVE CIRCUITRY

BACKGROUND OF THE INVENTION

The present invention relates to display arrays. More specifically, the invention relates to techniques for driving such arrays.

Lewis, EP-A 0 540 163, describes switched capacitor analog circuits realized using polysilicon TFT CMOS techology. The circuits can be integrated as analog driving circuitry for large area electronic (LAE) devices such as active matrix liquid crystal displays (AMLCDs). As shown and described in relation to FIGS. 3A–9, a switched capacitor amplifier can be constructed from polysilicon TFTs and TFCs; at col. 10 lines 3–11, Lewis indicates that an array of such amplifiers could be used to provide the parallel drive needed for data lines of an active matrix display. As shown and described in relation to FIGS. 10–15B, display driver architecture with digital-to-analog converters (DACs) can be constructed from polysilicon TFTs and TFCs; a multiplexer at the output of each DAC allow the DAC to serve several lines.

Stewart, R. G., Lee, S. N., Ipri, A. C., Jose, D. L., Furst, D. A., Lipp, S. A., and Roach, W. R., "A 9V Polysilicon LCD with Integrated Gray-Scale Drivers," *SID* 90 *Digest*, pp. 319–322, describe a self-scanned polysilicon display in which both data-line and select-line driver circuits were fabricated simultaneously with an active-matrix liquid crystal display. Scanner circuits are shown and described in relation to FIG. 2, gray scale data scanners in relation to FIG. 3. Timing and gray scale conversion are shown and described in relation to FIGS. 4*a* and 4*b*. This display is also described in Lee, S. N., Stewart, R. G., Ipri, A., Jose, D., and Lipp, S., "A 5×9 Inch Polysilicon Gray-Scale Color Head Down Display Chip," 1990 *IEEE International Solid-State Circuits Conference*, IEEE, 1990, pp. 220 and 221.

Morozumi, S., Oguchi, K., Misawa, T., Araki, R., and Ohshima, H., "4.25-in. and 1.51-in. B/W and Full-Color LC Video Displays Addressed by Poly-Si TFTs," *SID* 84 *Digest,* 1984, pp. 316–319, describe a 1.51 inch active matrix LCD with drivers integrated on the same substrate. Left and right Y-drivers each include 210 bit shift registers and upper and lower X-drivers each include 180 bit shift registers and sample and hold circuits (referred to as "sample holders"). The sample and hold circuits receive a video signal and provide the video signal to data lines under control of shift registers. The outputs of the upper and lower sample and hold circuits may be connected to each other through data lines and the left and right shift registers may be connected to each other through gate lines, providing redundancy.

SUMMARY OF THE INVENTION

Devices have been developed that make it possible to integrate an active matrix array for a display on the same substrate with its drive circuitry. Polysilicon thin film transistors (poly-Si TFTs), for example, can be used as switching elements in an active matrix array and can also be used in drive circuitry integrated on the same substrate as the array. For a transmission mode active matrix liquid crystal display (AMLCD), an array and its drive circuitry can both be formed on a transparent quartz wafer or a large area glass substrate.

The potential advantages of integrating array and drive circuitry on the same substrate include simpler and more reliable packaging, lower cost, and, most importantly, greater display pixel density. Applications that require high pixel densities and high gray scale precision include LCD projection systems, viewfinders, and virtual reality (VR) goggles.

A first aspect of the invention alleviates a basic problem in integrating an active matrix display on the same substrate with its drive circuitry. A tension arises between greater pixel density and circuit complexity, referred to herein as the "density versus complexity problem."

The density versus complexity problem arises because more complex integrated data drive circuits (providing more bits of gray scale) take up more area. This limits pixel density. Achieving high gray scale precision with integrated data drive circuits therefore makes it difficult to achieve high pixel density without increasing complexity and cost of external drive electronics.

In practice, the driving technique of Morozumi et al., cited above, although it provides a simple analog sampling scheme, requires an analog video signal of sufficient voltage magnitude to drive the data lines. The sample and hold circuits can be implemented with pass gates that provide the video signal to each of the data lines in turn under control of the shift registers, as shown in FIG. 5(*b*) of Lewis, A. G., Lee, D. D., and Bruce, R. H., "Polysilicon TFT Circuit Design and Performance," *IEEE Journal of Solid-State Circuits*, Vol. 27, No. 12, December 1992, pp. 1833–1842. In this implementation, the pass gates must be able to charge the data lines at a sufficient rate to obtain adequate gray scale precision in the available line time. Therefore, as the number of display lines and the required gray scale precision increase, the necessary integrated sample and hold acquisition time and accuracy can only be achieved by increasing the number of analog input lines for receiving video signals, making the analog input interface and the required external circuitry significantly more complicated.

Stewart et al. and Lee et al., in the articles cited above, describe a chop ramp scanning technique used to handle 32 gray levels for a color display. Data scanners are partitioned into serial loaded registers driven from a multiplexed bus. Associated with the data scanner circuitry is a five-bit gray scale counter. In the chop ramp scanning technique, each data line is driven by a transmission gate that is controlled by output of a 5-bit counter. During the first line period, the 5-bit gray scale code for each pixel is loaded into the data shift registers. At the end of the line period, the data is transferred from the shift register latches to the counters. During the second line period, the master data bus is ramped from the lowest to the highest pixel voltage while each data line's counter is incremented until it reaches a count of 11111, at which time its transmission gate is turned off, determining the level to which the data line is charged. As a result, the analog voltage presented on each data line depends entirely on the contents of its respective counter. The chop ramp scanning circuit achieves digital-to-analog conversion.

The Stewart/Lee technique does not require an analog input interface. Instead, the shift registers convert digital serial input signals to parallel signals, and chop ramp scanning circuits, or DACs as shown in FIG. 5(*a*) of the Lewis et al. article cited above, convert each of the parallel signals to an analog signal that drives a is data line. Because a digital input interface is typically faster and less susceptible to noise and because digital drivers able to deliver the required voltage swing are much cheaper than high voltage analog video drivers, the Stewart/Lee technique can allow significantly simpler and cheaper external circuitry than the Morozumi et al. technique for applications that require high resolution and high gray scale precision. But the integrated shift registers and DACs are much more complex than the circuitry required for the Morozumi et al. technique, and the additional display complexity can severely impact yield.

Further, the extra glass area required by the input registers and DACs means that very high pixel densities cannot be achieved. This is particularly important in TFT AMLCDs used for projection systems, where the display must be small and the pixel density correspondingly high.

The first aspect of the invention is further based on the discovery of a technique that elegantly alleviates the density versus complexity problem. The technique obtains increased gray scale precision but can be implemented with simple integrated drive circuitry and a digital input interface.

The technique is applicable to a display in which scan signals are periodic at a scanning frequency, with each period including a duty interval; during the duty interval, a data signal includes a signal segment with a voltage magnitude. The technique builds on the fact that each cell's electrooptical element in an electrooptical display has a maximum response frequency above which the electrooptical element cannot respond discretely to signals received during consecutive cycles. The technique also builds on the fact that a normal human viewer has a maximum perceptual frequency above which the viewer cannot perceive switching between two different colors and instead perceives a continuous, intermediate color.

The technique can be implemented in an improved display with scan drive circuitry structured to provide a scanning frequency at least K times the lesser of the maximum response frequency of the electrooptical element and a normal human viewer's maximum perceptual frequency. In addition, the data drive circuitry is structured to receive digital input signals and, in response, to provide, during each duty interval, a signal segment with either a maximum or a minimum voltage magnitude. The electrooptical element receives either the maximum or the minimum voltage magnitude during each duty interval and presents, through time averaging, any of K distinct, continuous gray levels without perceptible flicker.

More generally, the technique can be implemented in an article of manufacture that includes array circuitry, scan drive circuitry, and data drive circuitry on a substrate. For each of a set of scan line/data line pairs, the array circuitry includes cell circuitry connected to the scan line and the data line. The cell circuitry includes an electrooptical element for controlling presentation of a part of images and a switching element for electrically connecting the data line and the electrooptical element under control of signals on the scan line. The electrooptical element has a data lead for receiving signals from the data line.

The scan drive circuitry provides a scan signal on each scan line, and each scan signal is periodic at a scanning frequency, with each period including a duty interval. The scanning frequency is at least K times the lesser of the maximum response frequency of the electrooptical element and a normal human viewer's maximum perceptual frequency, where K is eight or more.

The data drive circuitry responds to digital input signals by providing data signals to the data lines. Each cell's switching element electrically connects the data line and the data lead of the electrooptical element's component during each duty interval of the scan signal on the scan line.

The data signal provided by the data drive circuitry on the data line includes, during the duty interval of the scan signal, a signal segment with one of only two voltage magnitudes, a maximum voltage magnitude or a minimum voltage magnitude.

The electrooptical element therefore receives either approximately the maximum voltage magnitude or approximately the minimum voltage magnitude during the duty interval. The electrooptical element presents, through time averaging, any of K distinct, continuous gray levels without perceptible flicker.

In a liquid crystal implementation, the scanning frequency could, for example, be 480 per second, which would allow presentation of 8 distinct, continuous gray levels; 1920 per second, which would allow presentation of 32 distinct, continuous gray levels; or 3840 per second, which would allow presentation of 64 distinct, continuous gray levels.

The minimum voltage magnitude can be approximately equal to the highest voltage that can be applied without changing the electrooptical element from its lowvoltage state. In a normally white implementation, the maximum voltage magnitude can drive an electrooptical element toward a state in which it presents its part of images at minimum intensity, while the minimum voltage magnitude can drive an electrooptical element toward a state in which it presents its part at maximum intensity, and vice versa for a normally black implementation. The minimum voltage magnitude could thus be approximately zero volts RMS, the maximum approximately five volts RMS or another voltage appropriate for the particular type of electrooptical element being driven.

The article of manufacture can be used as active matrix circuitry for a light valve, and can be applied, for example, in an active matrix liquid crystal display (AMLCD) or other electrooptical display such as an electroluminescent display or a plasma display. If the scanning frequency, the duty intervals, and the signal segments are appropriately related, a viewer of the AMLCD will see K levels of color even though the data drive circuitry provides signals on the data lines at only two voltage magnitudes.

Each cell's switching element can be a poly-Si TFT, and the scan drive circuitry and data drive circuitry can also include poly-Si TFTs. Because of the high drive frequencies and the short charge storage time required of each electrooptical element, each element's storage capacitor can be lower than for a conventional AMLCD, and the normal strict requirements for low switch leakage current are relaxed. Therefore, each cell's circuitry can be simplified by shrinking or omitting its storage capacitor and by using a simple TFT instead of one designed for low leakage such as a dual gate or LDD device.

The technique described above is advantageous because it can provide good gray scale precision, such as six to eight bits, with simpler integrated circuitry that receives digital input signals. Because the data drive circuitry provides signals at only two voltage magnitudes rather than an analog value, the technique does not require DACs, such as the Stewart/Lee chop ramp scanning circuits.

If the scan drive circuitry and data drive circuitry provide signals at sufficient frequencies as described above, the need is also eliminated for an additional capacitor in each cell to ensure linearity by reducing voltage-dependent change in capacitance, as occurs with liquid crystal (LC), because the LC capacitance will not have time to change during the scan period.

As a result of these simplifications, the overall yield of the integrated circuitry will be increased. In addition, the technique makes it unnecessary to increase scan line capacitance by using parts of each scan line as storage capacitor electrodes, making it easier to achieve higher scanning frequencies.

In comparison with a multiplexed analog architecture like that of Morozumi et al., cited above, the techniques described above are advantageous because they do not require as many input lines for high resolution, high image fidelity displays. The time necessary to charge data lines, typically about 1 $\mu$s on a high resolution display, means that multiplexers cannot be wide so that many analog inputs are required, one for each multiplexer. Also, multiplexed designs have an inherent uniformity problem because the last line charged tends to see different parasitic coupling effects from the first line charged. With the above techniques, all data lines are charged concurrently, eliminating this problem. Finally, a multiplexed analog architecture typically requires an external high-voltage DAC for every input line, but the techniques described above perform digital-to-analog conversion by dithering or by time averaging at the electrooptical element, requiring only two external dc signal levels or, if the backplane or counterelectrode is not switched, three or four external dc signal levels.

In comparison with an integrated DAC architecture like the Stewart/Lee technique, the techniques described above are advantageous because they is allow simpler circuitry on the display glass, as described above. The large amount of circuitry required to drive each data line with integrated DACs precludes small data line pitch and therefore limits matrix density, but the techniques described above allow high matrix density. In addition, integrated DACs typically require generation of eight or more precision dc levels or a pair of external ramps. The techniques described above, however, can be implemented with only two or three external signal levels.

The following description, the drawings, and the claims further set forth these and other aspects, objects, features, and advantages of the invention.

DETAILED DESCRIPTION

A. Conceptual Framework

Figure 1:
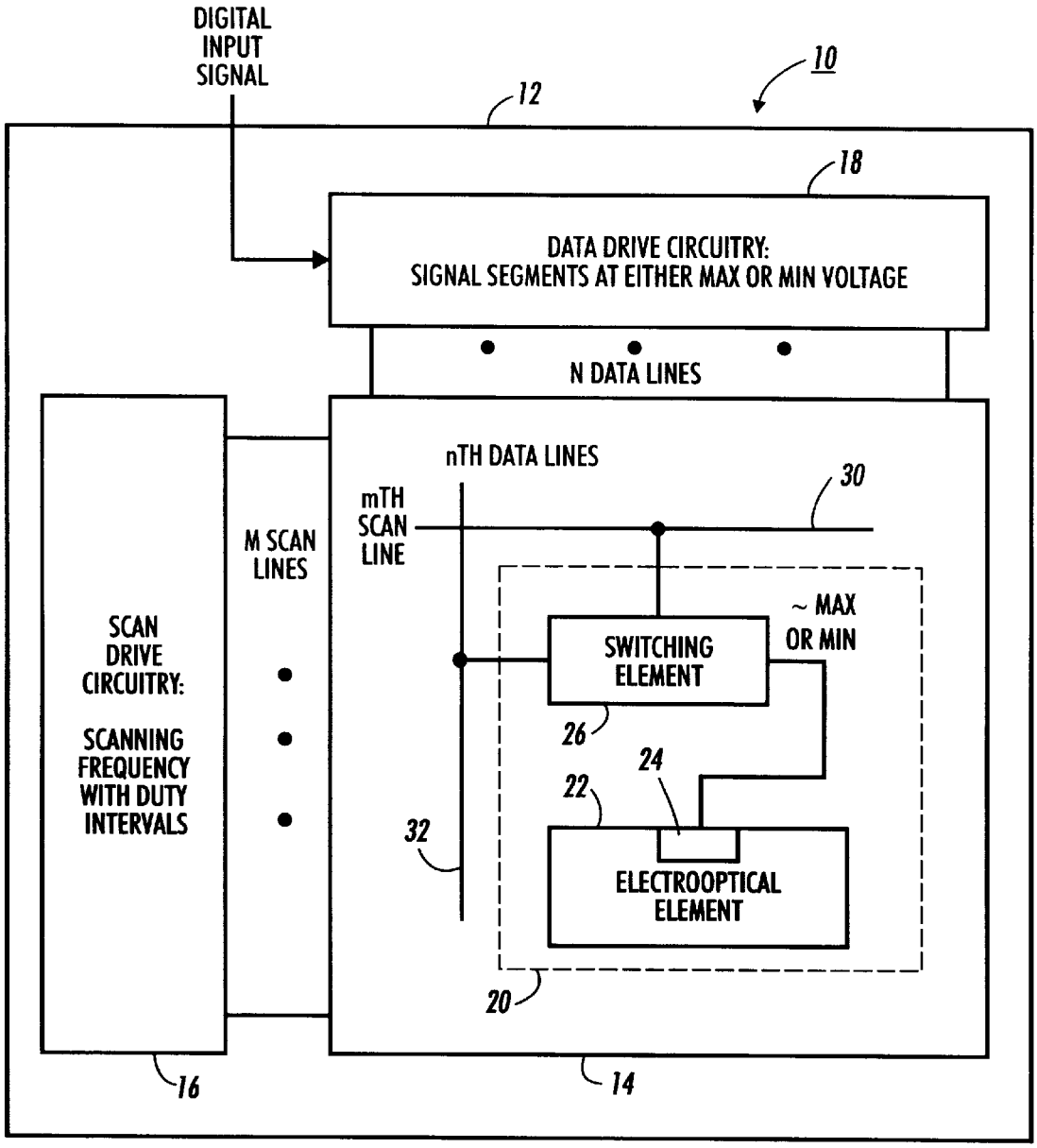
FIG. 1 is a schematic circuit diagram showing scan drive circuitry that provides a scanning frequency and data drive circuitry that responds to digital input signals by providing either a maximum voltage magnitude or a minimum voltage magnitude, so that an electrooptical element in an array receives either approximately the maximum voltage magnitude or approximately the minimum voltage magnitude during a duty interval.

The following conceptual framework is helpful in understanding the broad scope of the invention, and the terms defined below have the indicated meanings throughout this application, including the claims.

The term "data" refers herein to physical signals that indicate or include information. When an item of data can indicate one of a number of possible alternatives, the item of data has one of a number of "values." For example, a binary item of data, also referred to as a "bit," has one of two values, interchangeably referred to as "1" and "0" or "ON" and "OFF" or "high" and "low."

A bit is an "inverse" of another bit if the two bits have different values. An N-bit item of data has one of $2^N$ values.

The term "data" includes data existing in any physical form, and includes data that are transitory or are being stored or transmitted. For example, data could exist as electromagnetic or other transmitted signals or as signals stored in electronic, magnetic, or other form.

"Circuitry" or a "circuit" is any physical arrangement of matter that can respond to a first signal at one location or time by providing a second signal at another location or time, where the timing or content of the second signal provides information about timing or content of the first signal. Circuitry "transfers" a first signal when it receives the first signal at a first location and, in response, provides the second signal at a second location.

Any two components are "connected" when there is a combination of circuitry that can transfer signals from one of the components to the other. For example, two components are "connected" by any combination of connections between them that permits transfer of signals from one of the components to the other. Two components are "electrically connected" when there is a combination of circuitry that can transfer electric signals from one to the other. Two components could be electrically connected even though they are not physically connected, such as through a capacitive coupling.

When circuitry transfers a signal from a first component to a second component, the first component "provides" the signal, and the second component "receives" the signal. A "signal interval" is a period of time during which a signal is provided or received.

A "substrate" is a unit of material that has a surface at which circuitry can be formed or mounted. An "insulating substrate" is a substrate through which no electric current can flow.

An "electric circuit" is a circuit within which components are electrically connected. An "electric structure" is a physical structure that includes one or more electric circuits.

A component of an electric circuit is "structured for" performing a function if the component includes subcomponents that are connected in such a way that they can perform the function.

A "thin-film structure" is an electric structure that is formed at a surface of an insulating substrate. A thin-film structure could be formed, for example, by deposition and patterned etching of films on the insulating substrate's surface.

An "integrated circuit" is a circuit formed at a substrate's surface by batch processes such as deposition, lithography, etching, oxidation, diffusion, implantation, annealing, and so forth.

A "lead" is a part of a component at which the component is electrically connected to other components. A "line" is a simple component that extends between and electrically connects two or more leads. A line is "connected between" the components or leads it electrically connects. A lead of a component is "connected" to a lead of another component when the two leads are electrically connected by a combination of leads and lines. In an integrated circuit, leads of two components may also be "connected" by being formed as a single lead that is part of both components.

The terms "array" and "cell" are related: An "array" is an article of manufacture that includes an arrangement of "cells." For example, a "two-dimensional array" or "2D array" includes an arrangement of cells in two dimensions. A 2D array of circuitry may include rows and columns, with a line for each row and a line for each column. Lines in one direction may be "data lines" through which a cell receives or provides signals, referred to as "data signals," that determine or indicate its state. Lines in the other direction may be "scan lines" through which a cell receives a signal, referred to as a "scan signal," enabling it to receive signals from or provide signals to its data line.

"Scan drive circuitry" is circuitry that provides scan signals to the scan lines of an array. In an array in which a cell receives data signals from its data line, "data drive circuitry" is circuitry that provides data signals to the data line of the array.

In an array of circuitry, "cell circuitry" is circuitry connected to a cell's scan line and data line.

A scan signal's "duty interval" is the signal interval during which a cell connected to receive the scan signal is enabled to receive or provide data signals through its data line.

Cell circuitry may include a "switching element," meaning a component that receives a scan signal from the cell's scan line and, during the scan signal's duty interval, electrically connects the cell's data line to another component of the cell circuitry.

A "signal segment" of a data signal is a segment of the data signal that is provided on a data line during the duty interval of a scan signal on a scan line.

The "voltage magnitude" of a signal segment on a data line is the magnitude of the voltage on the data line during the signal segment. The voltage magnitude is independent of the polarity of the voltage during the signal segment, and can, for example, be measured as a root mean square (RMS) voltage over the duration of the signal segment.

A "scanning frequency" is a frequency at which scan signals are provided to an array. The period of a scanning frequency is the time necessary to scan the entire array, and is typically the interval between successive duty intervals of one of the scan signals.

In a thin film structure, the terms "gate region," "gated region," and "channel" have related meanings: A "gate region," sometimes called a "gate," is a part of a layer that controls conductivity of a "gated region" that is part of another layer, typically defined by the projection of the gate region onto the other layer; conversely, a "gated region" is a part of a layer with conductivity that changes depending on the gate region; a "channel" is formed when current flows through a gated region. A channel is "highly conductive" or "ON" when the channel is in a state in which current can flow freely through it. A channel is "OFF" when the channel is in a state in which very little current can flow through it.

A "channel lead" is a lead that connects to a channel. A channel may, for example, extend between two channel leads.

A "transistor" is a component that has a channel that extends between two channel leads, and that also has a third lead—referred to as a "gate lead" or simply "gate"—such that the channel can be switched between high impedance and low impedance by signals that change potential difference between the gate and one of the channel leads, referred to as the "source." The channel lead that is not the source is referred to as the "drain." Other components may have leads called gates, sources, and drains by analogy to transistors.

A "thin-film transistor" or "TFT" is a transistor that is part of a thin-film structure.

An "polysilicon thin film transistor" or "poly-Si TFT" is a TFT with a gated region that is part of a layer of polysilicon, so that the TFT's channel is formed in polysilicon.

Two components are electrically connected "under control of" signals on a line if a signal on the line can change conductivity of a third component connected between the two components so that the two components are electrically connected. The third component is "for electrically connecting" the two components under control of signals on the line.

An "image" is a pattern of physical light. When an image is a pattern of physical light in the visible portion of the electromagnetic spectrum, the image can produce human perceptions.

An "image output device" is a device that can provide output defining an image.

A "light valve" is an image output device that includes an array of cells that can is produce an image in light passing through or reflected from the array.

A "display" is an image output device that provides information in a form visible to humans.

In a display, a "transducing element" is an element that responds to an electric signal by changing an optical characteristic, such as by emitting light or by changing transmissivity or reflectivity to light.

An "electrooptical element" is a component that is structured to receive an electric signal and to respond to the voltage of the electric signal by changing an optical characteristic. For example, an electrooptical element may respond to an electric signal by emitting light or by changing transmissivity or reflectivity to light. An electrooptical element may include a data lead through which the component receives an electric signal and a transducing element that responds to the electric signal by changing the optical characteristic.

An electrooptical element may have a "low voltage state," meaning a state that it is in when zero voltage is applied, a state in which it operates almost independent of voltage changes until it receives an electric signal with a voltage magnitude above a threshold. The threshold is thus the highest voltage magnitude the electrooptical element may receive without changing from its low voltage state. Similarly, an electrooptical element may have a "high voltage state" in which it operates almost independent unless its voltage drops below a lower limit. Between its threshold and the lower limit of its high voltage state, an electrooptical element is highly sensitive to voltage.

An electrooptical element's "maximum response frequency" or "MRF" is a maximum frequency above which the electrooptical element can respond discretely to a received electric signal. In other words, if the received electric signal includes only frequencies above the MRF, the electrooptical element cannot respond discretely to each cycle of the received electric signal, but rather responds to a number of the cycles that it has received most recently.

A "liquid crystal cell" is an enclosure containing a liquid crystal material.

A "liquid crystal display" or "LCD" is a display that includes a liquid crystal cell and an array, where the liquid crystal cell has a light transmission or reflection to characteristic that can be controlled by the array to cause presentation of an image. Each cell's circuitry in the array can cause presentation of a part of an image by controlling the light transmission or reflection characteristic for an adjacent part of the liquid crystal cell. The cell's circuitry together with the adjacent part of the liquid crystal cell therefore form an electrooptical element.

An "active matrix liquid crystal display" or "AMLCD" is a liquid crystal display in which each cell's circuitry in the array has a nonlinear switching element that controls presentation of a part of an image. The switching element could, for example, be a TFT.

An "electrooptical display" is a display with an array whose cells include electrooptical elements, each of which presents a part of an image presented by the display. Examples include transmissive and reflective LCDs, electroluminescent displays, and plasma displays. In an electrooptical display, an electrooptical element is "for controlling presentation of a part of images."

An item of data "defines" or "includes" an image when the item of data includes sufficient information to produce the image, such as by presenting it on a display. For example, a two-dimensional array of data can define all or any part of an image, with each item of data in the array providing a value indicating the color of a respective location of the image. Each item of data could, for example, indicate a gray scale level or a color of its location.

A "normal human viewer" of a display is a human whose vision meets an appropriate criterion for normalcy. For example, the criterion could require 20/20 equivalent or better corrected visual acuity, normal vertical and lateral phoria, normal stereopsis, and normal color vision.

A normal human viewer's "maximum perceptual frequency" or "MPF" is the frequency at which a normal human viewer of a display cannot perceive switching of the display between two different colors and instead perceives a continuous, intermediate color. Above the maximum perceptual frequency, the normal human viewer perceives "flicker," meaning a switching between two different colors presented by the display.

A scanning frequency is "at least K times the lesser of" an MRF and an MPF if K times the smaller of the MRF and the MPF is no greater than the scanning frequency.

A "digital signal" is an electric signal whose voltage magnitude provides time varying information at discrete values, typically two discrete values interchangeably referred to as "high" and "low," "ON" and "OFF," or "0" and "1."

"Digital input leads" are leads through which a component can receive digital signals.

Data drive circuitry provides, "during each duty interval, a signal segment with either a maximum or a minimum voltage magnitude" if the data drive circuitry provides a signal segment to a data line during the duty interval with one of only two voltage magnitudes, the maximum voltage magnitude and the minimum voltage magnitude.

B. General Features

Figure 2:
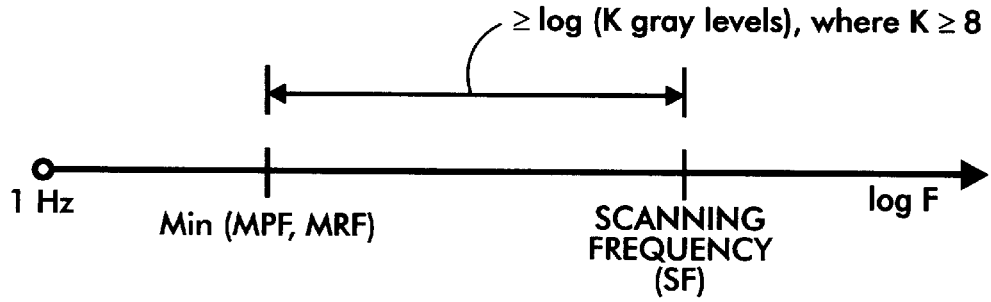
FIG. 2 is a diagram showing frequencies of signals provided by the scan drive circuitry of FIG. 1, with the scanning frequency sufficiently great to present, through time averaging, any of K distinct, continuous gray levels without flicker, where K is 8 or more.

FIGS. 1 and 2 show general features of the invention. FIG. 1 shows scan drive circuitry that provides a scanning frequency with a duty interval and data drive circuitry that responds to digital input signals by providing either a maximum voltage magnitude or a minimum voltage magnitude, so that an electrooptical element in an array receives either approximately the maximum voltage magnitude or approximately the minimum voltage magnitude during a duty interval. FIG. 2 shows how the scanning frequency of signals provided by the scan drive circuitry of FIG. 1 is at least K times as great as the lesser of the electrooptical element's maximum response frequency and the maximum perceptual frequency, where K is 8 or more.

Article 10 in FIG. 1 includes substrate 12 with circuitry formed on its surface. The circuitry includes array circuitry 14, scan drive circuitry 16, and data drive circuitry 18.

Array circuitry 14 includes M scan lines and N data lines. For each of a set of scan line/data line pairs, array circuitry 14 also includes cell circuitry connected to the scan line and the data line, with cell circuitry 20 being illustratively shown connected to mth scan line 30 and nth data line 32.

Cell circuitry 20 includes an electrooptical element 22, and electrooptical element 22 has data lead 24. Cell circuitry 20 also includes switching element 26 for electrically connecting nth data line 32 and data lead 24 under control of signals on mth scan line 30.

Scan drive circuitry 16 provides a scan signal on each scan line. As indicated in FIG. 1, the scan signal is a periodic signal that is provided at a scanning frequency and that has a duty interval during each period. The duty interval could, for example, be approximately (1/M)th of a period or less, and the scan signals could be synchronized so that no two scan lines have overlapping duty intervals.

Data drive circuitry 18 has leads for receiving digital input signals, and responds to the digital input signals by providing a data signal on each data line. The data signal provided by data drive circuitry 18 on each data line includes a signal segment during each scan signal duty interval, and the signal segment has one of only two voltage magnitudes. The greater or maximum of the two voltage magnitudes is referred to in FIG. 1 as "MAX", while the lesser or minimum voltage magnitude is referred to as "MIN." As shown, electrooptical element 22 receives either approximately MAX or approximately MIN during each duty interval.

Relationships between the relevant frequencies along a logarithmic frequency (log F) axis are shown in greater detail in FIG. 2. The maximum perceptual frequency (MPF), i.e. the maximum frequency at which a normal human viewer can perceive switching between two different colors, above which the normal human viewer instead perceives a continuous, intermediate color, is approximately 60 Hz, as indicated by Numao, U.S. Pat. No. 5,488,495, at col. 4 lines 35–39. The maximum response frequency (MRF), i.e. the maximum frequency at which electrooptical element 20 can respond independently to successive signals, will depend on the manner in which electrooptical element 20 is implemented. In an LCD, for example, the MRF may not be constant across array circuitry 14, but will typically be approximately 20–60 Hz, as described in Fiske, T., Hack, M., Martin, R. A., and Steemers, H., "Analysis of Transient Optical Response of Active-Matrix LCDs," *SID* 95 *Digest, May* 1995, pp. 743–746.

The scanning frequency (SF) is at least K times the lesser of MPF and MRF, where K is the number of gray levels and $K \geqq 8$. In other words, the distance along the log F axis from the lesser of MPF and MRF (referred to in FIG. 2 as "Min (MPF, MRF)") to SF is at least as great as log K. The electrooptical element can therefore present, through time averaging, any of K distinct, continuous gray levels without perceptible flicker.

If we take Min(MPF, MRF)=60 Hz, at K=8 gray levels, we obtain the minimum value of SF=480 Hz, meaning that the entire array must be scanned 480 times per second. This SF allows a maximum duty interval of (1/480M) seconds on each of M scan lines. To increase the number of gray levels to 64, SF must be multiplied by at least 8, yielding, at a minimum, SF=3840 Hz.

C. Implementation

The general features described above could be implemented in numerous ways. An implementation described below provides a liquid crystal light valve with poly-Si TFTs. As an example, this implementation provides a display with 640×480 electrooptical elements (also referred to simply as "pixels").

C. 1. Light Valve

Figure 3:
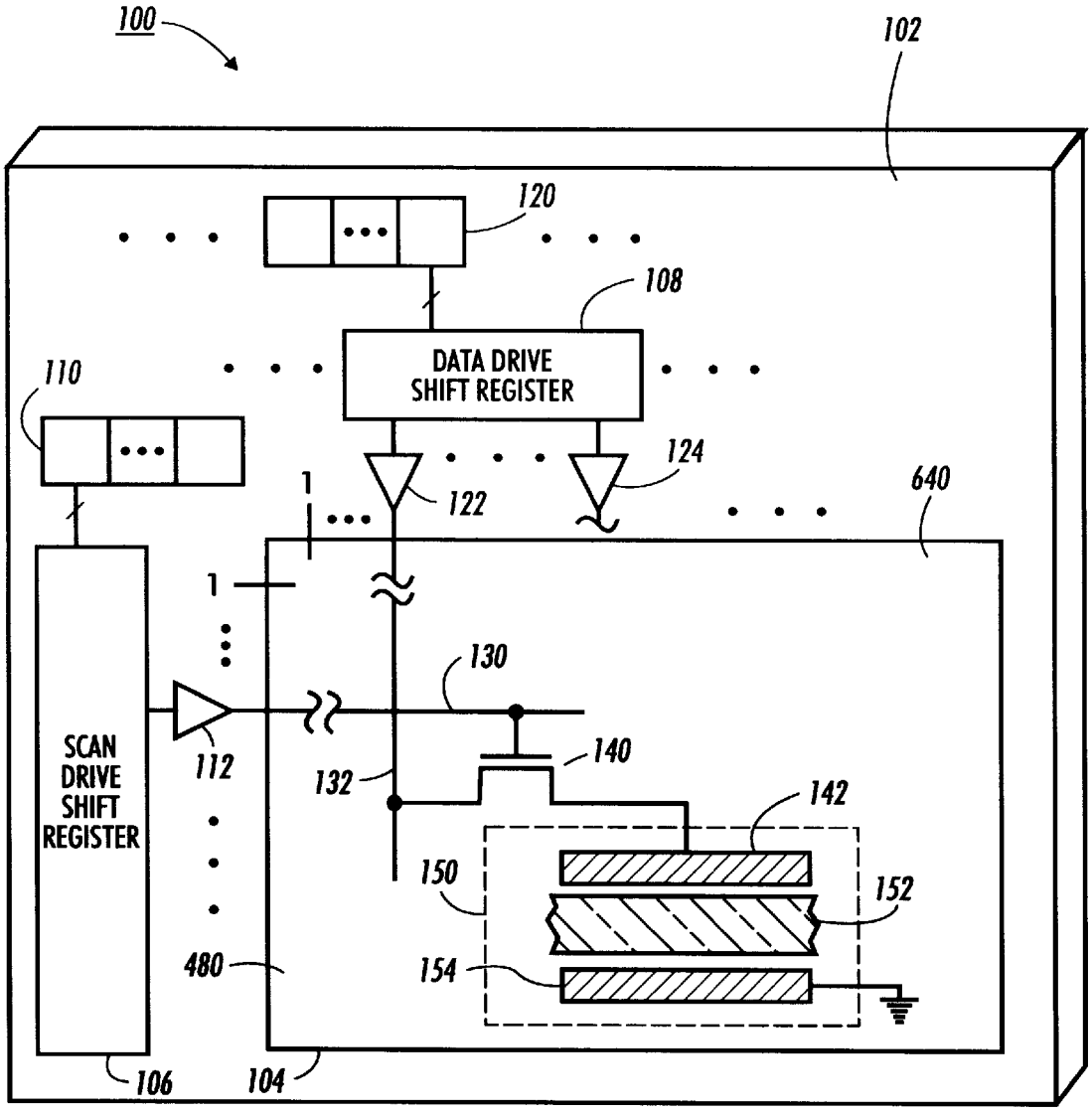
FIG. 3 is a schematic diagram showing a liquid crystal light valve that includes data drive circuitry and scan drive circuitry that operate as in FIG. 1.

FIG. 3 shows relevant features of a liquid crystal light valve in which the general features described above could be implemented.

Light valve 100 in FIG. 3 includes substrate 102 on a surface of which circuitry is formed, including array 104, scan drive shift register 106, and data drive shift register 108. Scan drive shift register 106 is connected to receive external synchronization signals from pads 110, and provides a scan signal to each of 480 scan lines in array 104 through a buffer, with buffer 112 being illustratively shown. Data drive shift register 108 is similarly connected to receive an external digital input signal from pads 120, and provides a data signal to each of 640 data lines in array 104 through a driver, with drivers 122 and 124 illustratively shown in FIG. 3.

In the region where scan line 130 and data line 132 cross, array 104 includes cell circuitry, some features of which are shown schematically in FIG. 3. TFT 140 has its gate connected for receiving scan signals provided on scan line 130. During a scan signal's duty interval, the channel of TFT 140 electrically connects data line 132 to electrode 142 so that a data signal provided on data line 132 reaches electrode 142. Electrode 142, together with the other components shown in cross-section in detail 150, functions as a capacitor, temporarily storing a data signal received from data line 132. Light transmissivity of liquid crystal region 152 is controlled by data signals received from data line 132. Electrode 154 is on another substrate on the opposite side of liquid crystal region 152, and can be held at ground as shown.

Substrate 102 can be a transparent quartz wafer or a large area glass substrate. TFT 140 can be a polysilicon (poly-Si) TFT and the components of scan drive circuitry and data drive circuitry can similarly be implemented with poly-Si TFTs, as discussed in more detail below.

Scan line 130 and the other scan lines and data line 132 and the other data lines can be implemented with conventional techniques, some of which are described in copending, coassigned U.S. patent application Ser. No. 08/572,357, entitled "Array with Metal Scan Lines Controlling Semiconductor Gate Lines," and Ser. No. 08/367,983, entitled "Forming Array with Metal Scan Lines to Control Semiconductor Gate Lines," both incorporated herein by reference.

As can be understood from FIG. 3, the scan signal on scan line 130 has a duty interval no longer than 1/480 of each cycle of the scanning frequency. During the duty interval, data line 132 and all the other data lines provide data signals that are received by cells in the row connected to scan line 130. Electrode 142 receives no signals from data line 132 between duty intervals, but if the capacitance of the components in detail 150 is sufficiently great, a signal received during one duty interval will be stored until the next duty interval.

C.2. Scan Drive Circuitry

Figure 4:
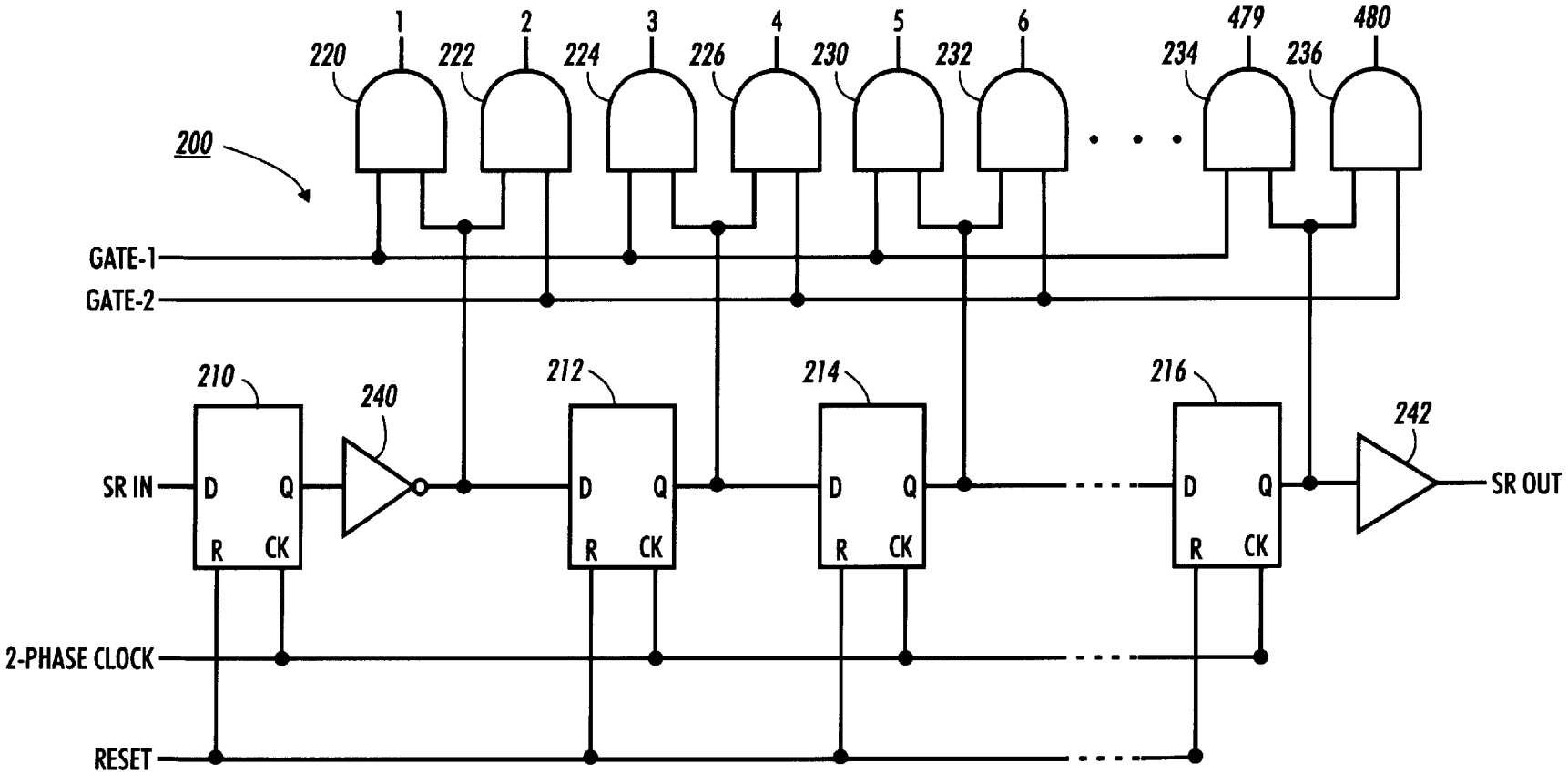
FIG. 4 is a schematic diagram showing an example of how the scan drive shift register of FIG. 3 could be implemented.
Figure 5:
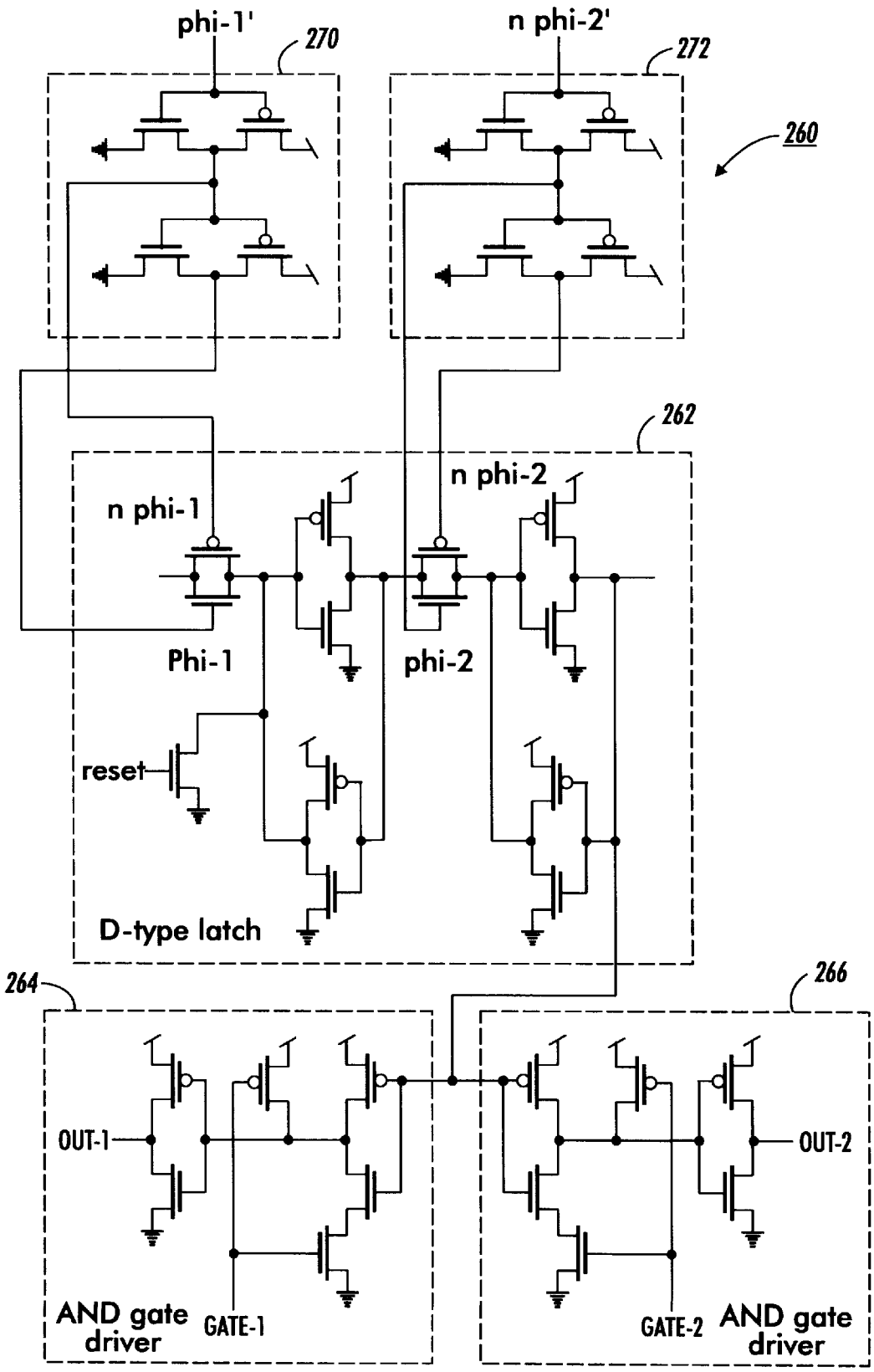
FIG. 5 is a schematic diagram showing how a stage of the scan drive shift register of FIG. 4 could be implemented.

The scan drive circuitry in the implementation of FIG. 3 includes scan drive shift register 106 and a buffer for each scan line as exemplified by buffer 112. FIG. 4 shows one way scan drive shift register 106 could be implemented. FIG. 5 shows a stage of shift register 106 as it could be implemented at the TFT level.

Scan drive circuitry 200 in FIG. 4 includes a 240 stage shift register, each stage of which provides scan signals on two scan lines. Each stage includes one of D-type latches 210, 212, 214 through 216. Each stage also includes a pair of AND gates, with the first stage including AND gates 220 and 222; the second, AND gates 224 and 226; the third, AND gates 230 and 232; and the last, AND gates 234 and 236. The first stage also includes inverter 240, and the last stage is followed by buffer 242 which provides the shift register output signal (SR out).

AND gates 220 through 236 are designed to drive the capacitive load presented by the scan lines of the array. With cell circuitry as described in relation to FIG. 3 above, the capacitive load will be somewhat less than with conventional techniques in which scan lines also function as electrodes of storage capacitors.

Two gate signals (Gate-1 and Gate-2 ) are used to shape the shift register output pulses and ensure that they do not overlap on the display. The arrangement by which each stage serves two scan lines offers two main advantages: First, a smaller shift register can be used, reducing area and improving yield; second, the display can operate in either an interlaced mode or a noninterlaced mode by enabling each odd or even scan lines only during the corresponding frame.

The shift register in FIG. 4 can be initialized when the Reset input, connected to the R input of each D-type latch, goes high. This causes all the Q outputs of latches 210, 212, 214, through 216 to go low, but inverter 240 in the first stage makes the output from the first stage high. If the shift register input (SR in) is held high as two-phase clock signals are applied, a high value will propagate along the shift register to provide scan signals on the scan lines as required.

Stage 260 in FIG. 5 includes D-type latch 262 and AND gate drivers 264 and 266. Clock buffer 270 receives clock signal phi-1' and provides clock signals phi-1 and nphi-1, while clock buffer 272 receives clock signal nphi-2' and provides clock signals nphi-2 and phi-2. Buffering the two phase clock at each stage minimizes clock skew problems, eliminates the need for a single buffer serving the entire register, and makes circuit operation independent of shift register length. AND gate drivers 264 and 266 are conventional CMOS structures with the TFTs in the final inverters (which provide out-1 and out-2) being large enough to drive the scan line capacitance at the required speed. In other words, AND gate drivers 264 and 266 must be able to drive scan lines with rise and fall times less than 100 ns while the shift register is operating at a clock rate well over 1 Mz. Lewis, A. G., Lee, D. D., and Bruce, R. H., "Polysilicon TFT Circuit Design and Performance," *IEEE Journal of Solid-State Circuits*, Vol. 27, No. 12, December 1992, pp. 1833–1842, provide further information about simple scan drive circuitry like that in FIGS. 4 and 5. Lewis et al., in relation to FIG. 6 on page 1837, indicate that error-free data transfer can be obtained at frequencies in the 9–30 MHz range using poly-Si TFT CMOS dynamic shift registers. Frequencies in that range can provide duty intervals short enough for scan drive circuitry as discussed above in relation to FIG. 2.

C.3. Data Drive Circuitry

Figure 6:
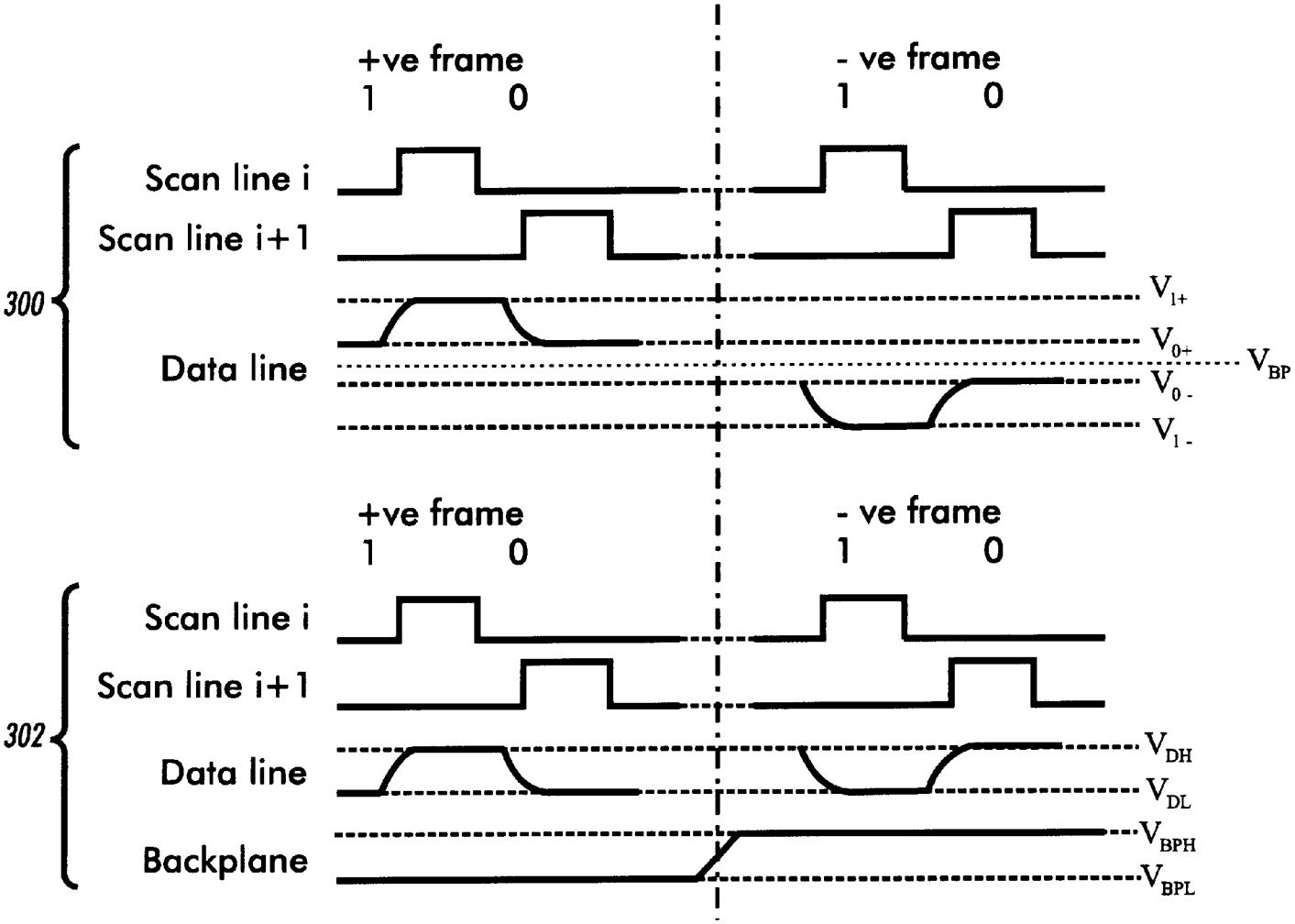
FIG. 6 is a timing diagram showing waveforms of signals that could be provided on scan lines and data lines in FIG. 3.

The data drive circuitry in the implementation of FIG. 3 includes data drive shift register 108 and a buffer for each data line as exemplified by buffers 122 and 124. FIG. 6 shows data driver waveforms.

Data drive circuitry, including shift register 108 and the data line buffers, could generally be implemented as described in Allen et al., U.S. Pat. No. 5,491,347, incorporated herein by reference. Allen et al. describe data drive circuitry that could be used at col. 14 line 31-col. 15 line 17 in relation to FIGS. 12–15. An implementation of this invention would integrate the circuitry on the same substrate with the array using 1 or 2 $\mu$m design rules rather than on separate chips with larger scale design rules as described by Allen et al.

Each stage of each data drive shift register could be implemented as described in Lewis, A. G., Lee, D. D., and Bruce, R. H., "Polysilicon TFT Circuit Design and Performance," *IEEE Journal of Solid-State Circuits*, Vol. 27, No. 12, December 1992, pp. 1833–1842, also incorporated herein by reference. Lewis et al., at pages 1836 and 1837, describe a shift register stage in relation to the inset in FIG. 6.

The Allen et al. data drive circuitry includes three level data drivers on the assumption that backplane voltage is held fixed. At least three voltage levels are necessary because the drive polarity seen by the liquid crystal region of each cell must be reversed every frame. Four level drivers could also be used with fixed backplane voltage.

If instead backplane voltage is reversed every frame, two level drivers could be used, with the data inverted to achieve the necessary polarity inversion, a technique used with amorphous silicon displays as described in relation to FIG. 5 of Lewis, A. G., and Turner, W., "Driver Circuits for AMLCDs," *Conference Record of the* 1994 *International Display Research Conference and International Workshop on Active-Matrix LCDs & Display Materials*, Monterey, Calif., Oct. 10–13, 1994, pp. 56–64, incorporated herein by reference. When the backplane is high, the pixel is driven high for a "0" and low for a "1" and vice versa when the backplane is low.

If a separate storage capacitor is used in each pixel, then the pixel's counter electrode must be switched along with the backplane. A problem with switched backplane driving schemes is that pixel voltage does not track the backplane exactly due to parasitic capacitances. This failure to track can introduce non-uniformities since backplane tracking becomes dependent on pixel voltage. If necessary, this problem can be solved by writing a dummy sub-frame immediately before the backplane is switched, ensuring that any error caused by switching is the same for every pixel.

FIG. 6 illustrates data driver waveforms, with waveforms 300 being appropriate for a fixed backplane voltage, and with waveforms 302 being appropriate for a switched backplane voltage. Voltages are not shown to the same scale in both sets of waveforms. In both cases, scan signals on scan lines i and (i+1) are shown, with the duty interval on scan line i immediately preceding the duty interval on scan line (i+1). In both cases, the waveforms illustrate data drive inversion between sub-frames, but other inversion schemes could be used.

With fixed backplane voltage, a data signal representing "1" is provided at $V_{1+}$ during a positive frame, while a data signal representing "0" is provided at $V_{0+}$ during a positive frame. During a negative frame, a data signal representing "1" is provided at $V_{1-}$, while a data signal representing "0" is provided at $V_{0-}$. If $V_{0+}$ and $V_{0-}$ are equal, this results in only three voltage levels, but if $V_{0+}$ and $V_{0-}$ are unequal, this results in four voltage levels.

With switched backplane voltage, a data signal representing "1" is provided at $V_{DH}$ during a positive frame, while a data signal representing "0" is provided at $V_{DL}$ during a positive frame. During a negative frame, a data signal representing "1" is provided at $V_{DL}$, while a data signal representing "0" is provided at $V_{DH}$. Therefore, this technique only requires two voltage levels.

The data drive circuitry described above performs digital-to-analog conversion by time averaging, which is intrinsically linear. Liquid crystal material, however, has a nonlinear voltage-to-transmissivity transfer characteristic. Therefore, it may be advantageous to choose the minimum voltage magnitudes at $V_{OFF}$, the highest voltage magnitude that can be applied without changing the liquid crystal from its low voltage state. This makes it unnecessary to use part of the range to cover the low voltage state of the liquid crystal. In a normally white LCD, a pixel is white at $V_{OFF}$ and black at $V_{ON}$, but in a normally black LCD, a pixel is white at $V_{ON}$ and black at $V_{OFF}$.

With fixed backplane voltage as in waveforms 300, the voltage levels can be adjusted to give:

$V_{OFF}=V_{0+}-V_{BP}=V_{BP}-V_{0-}$; and $V_{ON}=V_{1+}-V_{BP}=V_{BP}-V_{1-}$.

With switched backplane voltage as in waveforms 302, the voltage levels can be adjusted to give:

$V_{OFF}=V_{DL}-V_{BPL}=V_{BPH}-V_{DH}$; and $V_{ON}=V_{DH}-V_{BPL}=V_{BPH}-V_{DL}$, with $V_{DL}>V_{BPL}$ and $V_{BPH}>V_{DH}$.

C.4. Cell Circuitry

Figure 7:
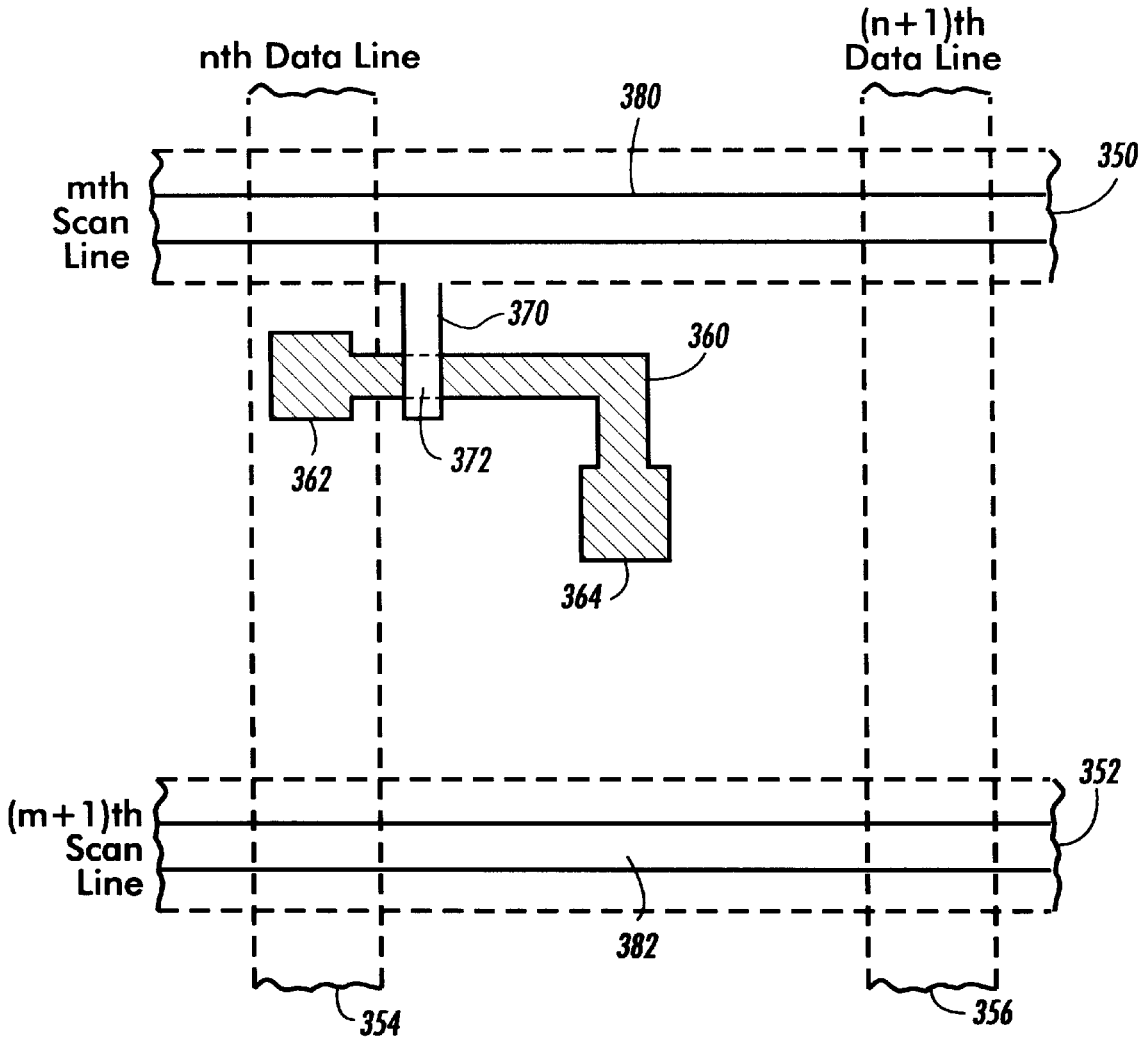
FIG. 7 is a schematic layout diagram showing how a cell in the array in FIG. 3 could be laid out.

The array of FIG. 3 could be implemented with simple cell circuitry like that described in Wu, I-W., "High-definition displays and technology trends in TFT-LCDs, " *Journal of the SID*, vol. 2, no. 1, 1994, pp.1–14 or with more complex cell circuitry like that described in copending, coassigned U.S. patent application Ser. No. 08/572,357, entitled "Array with Metal Scan Lines Controlling Semiconductor Gate Lines," both incorporated herein by reference, with appropriate adjustment of features to provide acceptable levels of capacitance. FIG. 7 shows an alternative cell layout that could be used in the implementation of FIG. 3.

FIG. 7 shows a part of array 104, with mth scan line 350, (m+1)th scan line 352, nth data line 354, and (n+1)th data line 356 in dashed lines. FIG. 7 also shows part of the cell circuitry for the cell that is connected to mth scan line 350 and nth data line 354.

The cell's circuitry includes poly-Si pattern 360, with a line that extends from first connecting point 362 to second connecting point 364. First connecting point 362 is substantially all within the edges of nth data line 354, to which it is electrically connected, such as by a through metal connection.

The cell's circuitry also includes gate pattern 370, a line that crosses poly-Si pattern 360 at channel 372. Gate pattern 370 extends from and is electrically connected to mth scan line 350. Gate pattern 370 could be formed in the same layer as mth scan line 350, with both being poly-Si or both being metal, or gate pattern could be formed in a different layer as described in copending, coassigned U.S. patent application Ser. No. 08/572,357, entitled "Array with Metal Scan Lines Controlling Semiconductor Gate Lines," and Ser. No. 08/367,983, entitled "Forming Array with Metal Scan Lines to Control Semiconductor Gate Lines," both incorporated herein by reference. In either case, scan lines could also include a layer of shunt metal to increase conductivity, as illustrated by shunts 380 and 382.

In the illustrated implementation, a scan signal on mth scan line 350 controls conductivity of poly-Si pattern 360 between first connecting point 362 and second connecting point 364. If the voltage on mth scan line 350 is high, channel 372 is highly conductive, but if the voltage on mth scan line 350 is low, channel 372 only passes leakage current.

The cell circuitry in FIG. 7 is designed without a separate storage capacitance. This improves cell response; in addition, scan line capacitance can be minimized because it is not necessary to provide capacitor electrodes along each scan line. An integrated dark matrix can be used to improve image quality by blocking stray illumination, as at edges, with minimum sacrifice of aperture.

The cell design illustrated in FIG. 7 has a single gate TFT rather than a dual gate TFT conventionally used to reduce leakage current. The cell design also eliminates storage capacitance in the cell. The cell design may nevertheless be adequate because the rapid refresh rate reduces the dynamic storage requirement for the cell.

Also, cell storage capacitance conventionally linearizes capacitance, which is important if the liquid crystal response time is comparable with the refresh time, since liquid crystal capacitance is highly voltage dependent. Without a linearizing capacitor, change in voltage on a cell causes the liquid crystal to respond during the frame time, change its capacitance, and alter voltage on the cell—several frames may be necessary to achieve the correct voltage on the cell and, hence, the correct gray level. But in this implementation, voltage on each cell is updated much more rapidly than the liquid crystal can respond, so that storage capacitance is not required to perform this linearizing function.

Elimination of the storage capacitor is advantageous because it simplifies fabrication—an additional masking step and implant that would be necessary to form a capacitor electrode can be eliminated. In addition, since a storage capacitor is conventionally formed using the gate dielectric, removing the capacitor reduces the total gate dielectric area, improving yield. The absence of a storage capacitor reduces scan line capacitance, making it possible to use smaller TFTs in the scan drivers, further improving yield. The absence of a storage capacitor also reduces overall pixel capacitance, making it easier to achieve the necessary fast pixel charging.

An array as described above could be fabricated using conventional techniques as described, for example, in Wu, I-W., Stuber, S., Tsai, C. C., Yao, W., Lewis, A., Fulks, R., Chiang, A., and Thompson, M., "Processing and Device Performance of Low-Temperature CMOS Poly-TFTs on 18.4-in.-Diagonal Substrates for AMLCD Application," *SID 92 DIGEST,* 1992, pp. 615–618, incorporated herein by reference.

C.5. Driving Techniques

Figure 8:
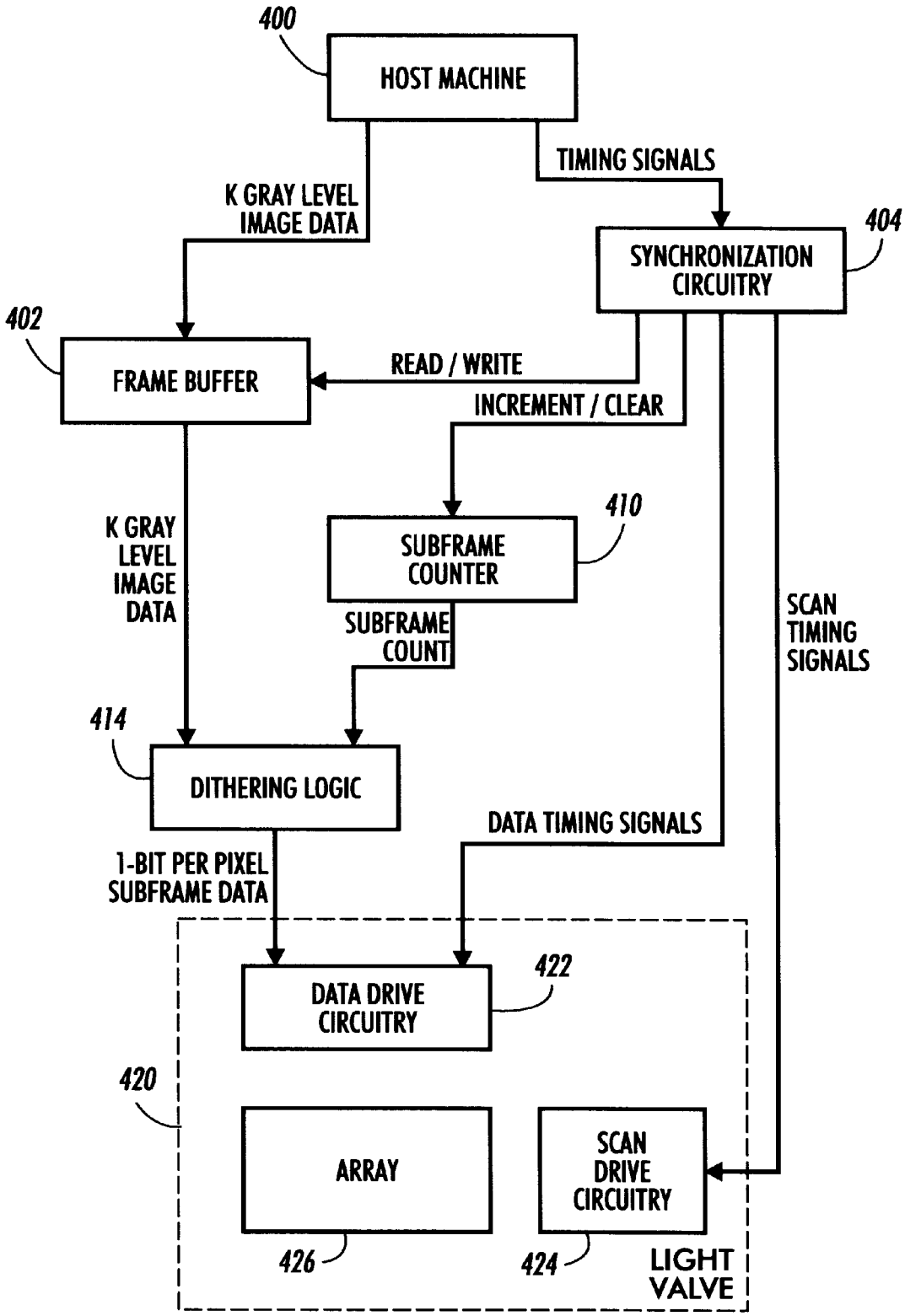
FIG. 8 is a functional blockdiagram showing functions that could be performed in using data defining an image with K gray levels into signals to provide signals to data drive circuitry and scan drive circuitry as in FIG. 3 so that the image is presented through time averaging without flicker.

A light valve produced as described above could be driven in many ways. FIG. 8 illustrates general functions that can be performed in providing signals to drive such a light valve.

Host machine 400 provides image data with K gray levels to frame buffer 402 and synchronization signals to synchronization circuitry 404. Frame buffer 402 stores and provides the image data in response to read/write signals from synchronization circuitry 404, all in accordance with conventional techniques.

Synchronization circuitry 404 also provides increment and clear signals to subframe counter 410, which can be a conventional counter that keeps a count indicating the current subframe for which data is being provided. Synchronization circuitry 404 also provides appropriate scan and data timing signals and which can be conventional except that the timing signals are provided at the high frequencies required to present images through time averaging without perceptible flicker.

Meanwhile, dithering logic 414 receives the image data with K gray levels from frame buffer 402 and also receives the current subframe count from subframe counter 410. In response, dithering logic 414 uses the image data to provide subframe data which includes, for each subframe, one bit per pixel of the image being presented by light valve 420. The subframe data and the data timing signals are received by data drive circuitry 422 while the scan timing signals are received by scan drive circuitry 424. In response, data drive circuitry 422 provides data signals on data lines in array 426 and scan drive circuitry 424 provides scan signals on scan lines in array 426 so that array 426 presents, though time averaging, the image defined by the K gray level image data without perceptible flicker.

For example, dithering logic 414 could perform temporal dithering using an appropriate algorithm to produce subframe data defining P subframe images from the the K gray level image data. These P subframe images together define a frame, and the image defined by the K gray level image data can be presented by time averaging the subframe images. If a switched backplane is used, the frame can also include a dummy subframe preceding each switching of the backplane, to ensure that any error caused by switching is the same for every frame.

Table I illustrates how dithering logic 414 can map a four bit value indicating one of 16 grayscale levels into 15 subframes, in the case where P=15. If the four bit value is 1111, for example, all 15 subframes are ON; if the four bit value is 1010, only the odd subframes and subframes 4 and 12 are ON; if the four bit value is 0101, all the even subframes are ON except subframes 4 and 12; and so forth.

TABLE I

| Subframe | Bit Passed |
|---|---|
| 1 | Bit 0 (MSB) |
| 2 | Bit 1 |
| 3 | Bit 0 |
| 4 | Bit 2 |
| 5 | Bit 0 |
| 6 | Bit 1 |
| 7 | Bit 0 |
| 8 | Bit 3 (LSB) |
| 9 | Bit 0 |
| 10 | Bit 1 |
| 11 | Bit 0 |
| 12 | Bit 2 |
| 13 | Bit 0 |
| 14 | Bit 1 |
| 15 | Bit 0 |
| 16 (optional) | Always Off |

The Technique of Table I could be extended in a straightforward way to cover more or less gray levels with more or less subframes as necessary. For example, with eight gray levels, seven subframes could be used by taking only subframes 1–7 from Table I; with 32, 31 subframes could be used by repeating subframes 1–15 from Table I twice, separated by a 16th subframe that passes bit 4; with 64, 63 subframes could be used by repeating the 31 subframes for 32 gray levels twice, separated by a 32nd subframe that passes bit 5; etc.

Dithering logic 414 could be implemented with simple combinatorial logic to select one of the bits at a time. If needed, dithering logic 414 could be implemented with table lookup, for example, for rapid conversion of output image pixel values to subframe pixel values. Dithering logic 414 could alternatively be implemented with subframe buffering using conventional frame buffer storage techniques, but simplified because only one bit would be stored per pixel for each subframe. A memory could store bit string with the same length as a full pixel value for each pixel, and the stored values could be read out bit serially in response to the count from subframe counter 410.

As suggested in Table I, the refresh rate for high order bits is faster than for low order bits. Thus, if the liquid crystal material can respond fast enough to produce flicker, the amplitude of the flicker falls as the frequency falls. Since human sensitivity to flicker decreases as flicker luminance amplitude reduces, it may be possible to increase gray scale precision (i.e. increase the number of subframes) by increasing the overall frame time as well as by speeding up the subframes. For example, a 2 kHz subframe rate could be used with 8-bit precision gray scale, giving an 8 Hz frame rate. The five most significant data bits would be written to the display at 64 Hz or above, and the data would be updated at this rate. Rapidly moving images would still show smooth movement with some loss of gray scale, while static images would achieve full 8-bit gray scale.

The technique of Table I is based on a temporal dithering strategy that presents low amplitude color changes with lower frequencies. Because such colors have smaller perceptible differences in brightness, flicker is less perceptible between them than it would be between higher intensity colors. As a result, the technique of Table I should provide no visible flicker even with subframe times that would produce flicker between high amplitude color changes.

The technique of Table I can thus allow undecoded binary data to be written to the display while at the same time avoiding flicker.

Display control signal generator 412 provides timing signals to scan drive circuitry 424 and to data drive circuitry 422 so that the subframes are provided to the cells of the array in sequence. For example, a normal image frame time can be divided into K subframes, with K being the required gray scale precision and with each subframe time much shorter than the longer of the response time of a cell's liquid crystal region and the minimum switching period at which flicker is perceptible. The whole array of cells can be updated once during each subframe by appropriate scan signals and by providing the one-bit value for each pixel of one subframe as data signals. As a result of the appropriate combination of ON and OFF subframes to a specific cell, the cell's liquid crystal region receives an RMS voltage resulting in presentation of a desired gray level.

C.6. Variations

The implementation described above provides thin film circuitry on an insulating substrate, such as quartz or glass. The invention could be implemented with other types of circuitry on other types of substrates.

The implementation described above includes electrooptical elements that control light transmissivity using liquid crystal. The invention could, however, be implemented with electrooptical elements that emit light or that control reflectivity rather than transmissivity and with electrooptical elements that do not use liquid crystal, such as in an electroluminescent display or a plasma display.

As described above, the invention could be implemented either with two level data drivers and backplane switching or with three or four level drivers, in which case backplane switching is not necessary.

The implementation described above includes data drive circuitry only along one side of an array, but the invention could be implemented with data drive circuitry along two opposite sides of an array.

The implementation described above includes scan drive circuitry only along one side of an array, but the invention could be implemented with scan drive circuitry along two opposite sides of an array and with redundancy, testing, and repair techniques as described in copending, coassigned U.S. patent application Ser. No. 08/575,784, entitled "Array with Redundant Integrated Self-Testing Scan Drivers," and Ser. No. 08/575,785, entitled "Array with Redundant Reparable Integrated Scan Drivers," both incorporated herein by reference.

The implementation described above uses specific driving rates that are attainable with currently available technology, but the invention could be implemented with much faster driving rates as technology to do so becomes available. Furthermore, higher driving rates would make it possible to obtain more gray scale levels.

The implementation described above provides circuitry with specific geometric and electric characteristics, but the invention could be implemented with different geometries and with different circuitry.

The implementation described above includes layers of specified thicknesses, produced from specified materials by specified processes, but other thicknesses could be produced, and other materials and processes could be used, such as thinner semiconductor and gate oxide layers to improve TFT performance. Rather than poly-Si, other semiconductor materials that provide sufficiently fast TFTs could be used in the semiconductor layers, including but not limited to CdSe, SiGe, or a composite layer of poly-Si and SiGe, or the invention could be implemented with a wide range of other insulated gate field effect transistors, including, but not limited to, SOI (silicon on insulator), SOQ (silicon on quartz) and SOS (silicon on sapphire), and bulk single crystal MOSFETs The implementation described above has a layout and a transmissive ITO layer appropriate for a light valve used in a display, but a layout and layers appropriate for another application could be used, such as a light valve used for another application. If an LCD light valve with twisted nematic liquid crystal material, an array appropriate for operation at VDD≦12V is required, but if with PDLC or cholesteric liquid crystal material, an array appropriate for operation at higher voltages may be required.

The above implementation employs enhancement mode n-channel TFTs that are highly conductive when gate voltage is high, but it may be possible to implement the invention with depletion mode TFTs or with p-channel TFTs.

The implementation described above uses a single gate TFT in a cell's circuitry, but the invention could be implemented with multiple gate TFTs and with techniques to reduce leakage current as described in copending, coassigned U.S. patent application Ser. No. 08/367,984, entitled "Circuitry with Gate Line Crossing Semiconductor Line at Two or More Channels"; Ser. No. 08/559,862, entitled "Array Having Multiple Channel Structures with Continuously Doped Interchannel Regions"; and Ser. No. 08/560,724, entitled "Forming Array Having Multiple Channel Structures with Continuously Doped Interchannel Regions," all incorporated herein by reference.

The implementation described above could be implemented in an array with a metal scan line controlling a semiconductor gate line in accordance with the inventions described in copending, coassigned U.S. patent application Ser. No. 08/572,357, entitled "Array with Metal Scan Lines Controlling Semiconductor Gate Lines," and Ser. No. 08/367,983, entitled "Forming Array with Metal Scan Lines to Control Semiconductor Gate Lines," both incorporated herein by reference. The invention could also, however, be implemented with other techniques to form other circuitry. For example, both the scan lines and the gate regions could be formed of the same metal or semiconductor material, which could be patterned in a single lithographic operation.

In the implementation described above, a poly-Si TFT has channels and channel leads formed in the same layer, but the channel leads could be in a different layer than the channels.

D. Application

The invention could be applied in many ways, including arrays for light valves and for various kinds of displays including direct viewing displays and projection displays. The invention is especially suitable for applications employing high density arrays, such as projection displays, viewfinders, and VR goggles.

E. Miscellaneous

The invention has been described in relation to thin-film implementations, but the invention might be implemented with single crystal technology.

Although the invention has been described in relation to various implementations, together with modifications, variations, and extensions thereof, other implementations, modifications, variations, and extensions are within the scope of the invention. The invention is therefore not limited by the description contained herein or by the drawings, but only by the claims.

What is claimed:

1. An improved display of the type having array circuitry, scan drive circuitry, and data drive circuitry at a surface of a substrate; the array circuitry including scan lines, data lines, and, for each of a set of scan line/data line pairs, cell circuitry connected to the scan line and the data line; the cell circuitry including:

an electrooptical element for controlling presentation of a part of images; and a switching element connected to receive a scan signal provided on the scan line by the scan drive circuitry; the scan signal being periodic at a scanning frequency, with each period including a duty interval during which the switching element electrically connects the data line and a data lead of an electrical component of the electrooptical element; the data drive circuitry providing a data signal on the data line that includes, during the duty interval, a signal segment with a voltage magnitude;

the improvement comprising, in combination:

the scan drive circuitry being structured to provide the scan signals with the scanning frequency being at least K times the lesser of a maximum response frequency of the electrooptical element and a normal human viewer's maximum perceptual frequency, where K is eight or more; and the data drive circuitry being structured to receive digital input signals from digital input leads and, in response, to provide, during each duty interval, a signal segment with either a maximum or a minimum voltage magnitude;

the electrooptical element receiving, during each duty interval, either approximately the maximum voltage magnitude or approximately the minimum voltage magnitude and presenting, through time averaging, any of K distinct, continuous gray levels without perceptible flicker.

2. The improved display of claim 1 in which K=16.

3. The improved display of claim 1 in which K=32.

4. The improved display of claim 1 in which K=64.

5. The improved display of claim 1 in which the electrooptical element has a low voltage state, the minimum voltage magnitude being approximately equal to the highest voltage magnitude that the electrooptical element can receive without changing from its low voltage state.

6. The improved display of claim 1 in which the display is an active matrix liquid crystal display.

7. An article of manufacture comprising:

a substrate with a surface at which circuitry can be formed;

array circuitry formed at the surface of the substrate for controlling presentation of images, the array circuitry comprising:

scan lines;

data lines; and for each of a set of scan line/data line pairs, cell circuitry connected to the scan line and the data line; the cell circuitry comprising:

an electrooptical element for controlling presentation of a part of images; the electrooptical element having a data lead; and a switching element for electrically connecting the data line and the electrooptical element's data lead under control of signals on the scan line;

scan drive circuitry formed at the surface of the substrate; the scan drive circuitry providing a scan signal on each scan line; each scan signal being periodic at a scanning frequency, with each period including a duty interval; the scanning frequency being at least K times the lesser of a maximum response frequency of the electrooptical element and a normal human viewer's maximum perceptual frequency, where K is eight or more; and data drive circuitry formed at the surface of the substrate; the data drive circuitry having digital input leads for receiving digital input signals; the data drive circuitry responding to the digital input signals by providing data signals to the data lines; the data signal on each data line including, during each duty interval, a signal segment with either a maximum or a minimum voltage magnitude;

for each scan line/data line pair in the set, the cell circuitry's switching element electrically connecting the data line to a data lead of the cell electrooptical element during each duty interval of the scan signal on the scan line;

the electrooptical element receiving, during each duty interval, either approximately the maximum voltage magnitude or approximately the minimum voltage magnitude and presenting, through time averaging, any of K distinct, continuous gray levels without perceptible flicker.

8. The article of claim 7 in which the maximum voltage magnitude drives the electrooptical element toward a first state in which the electrooptical element controls presentation of its part of images so that its part is presented at maximum intensity and the minimum voltage magnitude drives the electrooptical element toward a second state in which the electrooptical element controls presentation of its part of images so that its part is presented at minimum intensity.

9. The article of claim 7 in which the maximum voltage magnitude drives the electrooptical element toward a first state in which the electrooptical element controls presentation of its part of images so that its part is presented at minimum intensity and the minimum voltage magnitude drives the electrooptical element toward a second state in which the electrooptical element controls presentation of its part of images so that its part is presented at maximum intensity.

10. The article of claim 7 in which the switching element is a thin film transistor.

11. The article of claim 10 in which the switching element is a polysilicon thin film transistor.

12. The article of claim 10 in which the thin film transistor has a single gate.

13. The article of claim 7 in which the cell circuitry does not include a storage capacitor.

14. The article of claim 7 in which the scan drive circuitry comprises polysilicon thin film transistors.

15. The article of claim 7 in which the data drive circuitry comprises polysilicon thin film transistors.

16. The article of claim 7 in which the scanning frequency is at least 480 cycles per second.

17. A light valve comprising:

a substrate with a surface at which circuitry can be formed;

array circuitry formed at the surface of the substrate, the array circuitry comprising:

scan lines;

data lines; and for each scan line/data line pair, cell circuitry connected to the scan line and the data line; the cell circuitry comprising:

an electrooptical element with a data lead; the electrooptical element being electrically connected for receiving signals through the data lead; and a switching element for electrically connecting the data line and the data lead under control of signals on the scan line;

scan drive circuitry formed at the surface of the substrate; the scan drive circuitry providing a scan signal on each scan line; each scan signal being periodic at a scanning frequency, with each period including a duty interval; the scanning frequency being at least K times the lesser of a maximum response frequency of the electrooptical element and a normal human viewer's maximum perceptual frequency, where K is eight or more; and data drive circuitry formed at the surface of the substrate; the data drive circuitry having digital input leads for receiving digital input signals defining an image to be presented under control of the array circuitry; the data drive circuitry responding to the digital input signals by providing data signals to the data lines; the data signal on each data line including, during each duty interval, a signal segment with either a maximum or a minimum voltage magnitude; and in the cell circuitry each scan line/data line pair, the switching element electrically connecting the data line to the data lead during each duty interval of the scan signal on the scan line to provide signals from the data line to the electrooptical element; the electrooptical element receiving, during each duty interval, either approximately the maximum voltage magnitude or approximately the minimum voltage magnitude and controlling light within a region of images to present, through time averaging, any of K distinct, continuous gray levels without perceptible flicker.

18. The light valve of claim 17 in which the maximum voltage magnitude drives the electrooptical element toward a first state in which the electrooptical element controls presentation of its region of images so that its region is presented at maximum intensity and the minimum voltage magnitude drives the electrooptical element toward a second state in which the electrooptical element controls presentation of its region of images so that its region is presented at minimum intensity.

19. The light valve of claim 17 in which the maximum voltage magnitude drives the electrooptical element toward a first state in which the electrooptical element controls presentation of its region of images so that its region is presented at minimum intensity and the minimum voltage magnitude drives the electrooptical element toward a second state in which the electrooptical element controls presentation of its region of images so that its region is presented at maximum intensity.

20. The light valve of claim 17, further comprising liquid crystal positioned along the array circuitry; the electrooptical element of each scan line/data line pair including a region of the liquid crystal that responds to signals from the data line by controlling light within the region of the image.

* * * * *